US009070519B2

(12) United States Patent
Marushima et al.

(10) Patent No.: US 9,070,519 B2
(45) Date of Patent: Jun. 30, 2015

(54) SWITCHGEAR AND OPERATION MECHANISM FOR THE SAME

(71) Applicant: Kabushiki Kaisha Toshiba, Minato-ku (JP)

(72) Inventors: Satoshi Marushima, Kanagawa (JP); Yoshiaki Ohda, Kanagawa (JP); Masaharu Shimizu, Kanagawa (JP); Tooru Inoue, Kanagawa (JP); Yoshikata Kobayashi, Tokyo (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 14/070,859

(22) Filed: Nov. 4, 2013

(65) Prior Publication Data

US 2014/0054148 A1 Feb. 27, 2014

Related U.S. Application Data

(63) Continuation-in-part of application No. PCT/JP2012/005054, filed on Aug. 8, 2012.

(30) Foreign Application Priority Data

Aug. 9, 2011 (JP) ..... 2011-174045

(51) Int. Cl.
*H01H 3/00* (2006.01)
*H01H 33/34* (2006.01)
(Continued)

(52) U.S. Cl.
CPC ..... *H01H 3/32* (2013.01); *H01H 33/42* (2013.01); *H01H 33/40* (2013.01); *H01H 71/2463* (2013.01)

(58) Field of Classification Search
CPC ..... H01H 33/6662; H01H 3/30
USPC ..... 335/189, 131
See application file for complete search history.

(56) References Cited

U.S. PATENT DOCUMENTS 1,749,602 A * 3/1930 Peterson ..... 335/170
2,479,385 A * 8/1949 Madden ..... 335/40
(Continued)

FOREIGN PATENT DOCUMENTS

JP 50-81352 7/1975
JP 52-149263 11/1977
(Continued)

OTHER PUBLICATIONS

International Search Report mailed Sep. 25, 2012 for PCT/JP2012/005054 filed on Aug. 8, 2012 with English Translation.
(Continued)

*Primary Examiner* — Alexander Talpalatski
(74) *Attorney, Agent, or Firm* — Oblon, McClelland, Maier & Neustadt, L.L.P.

(57) ABSTRACT

The circuit opening operation section of an embodiment of switchgear operation mechanism comprises: a circuit opening electromagnetic solenoid having a fitting structure that is provided with a step; and a solenoid spacer for adjusting the distance between a circuit opening trigger mechanism and the circuit opening electromagnetic solenoid. The circuit opening solenoid has: a solenoid housing fixed in position by way of the solenoid spacer; a plunger; and a stopper fitted to the solenoid housing so as to limit the sliding motion of the plunger in the plunger returning direction when the coil is not supplied with electric power. The limiting position of the stopper is adjustable.

11 Claims, 13 Drawing Sheets

(51) Int. Cl.

| | |
|---|---|
| ***H01H 3/32*** | (2006.01) |
| ***H01H 33/40*** | (2006.01) |
| ***H01H 71/24*** | (2006.01) |
| *H01H 33/42* | (2006.01) |

(56) References Cited

U.S. PATENT DOCUMENTS

| | | | | |
|---|---|---|---|---|
| 2,540,185 | A * | 2/1951 | Brown | 335/156 |
| 2,605,327 | A * | 7/1952 | Russell | 335/240 |
| 3,091,725 | A * | 5/1963 | Huston | 335/230 |
| 3,249,823 | A * | 5/1966 | Beardow | 335/258 |
| 3,848,206 | A * | 11/1974 | Prouty et al. | 335/193 |
| 4,399,421 | A * | 8/1983 | MacLean | 335/174 |
| 4,965,543 | A | 10/1990 | Batteux | |
| 6,218,921 | B1 * | 4/2001 | Eberts et al. | 335/176 |
| 7,772,513 | B2 | 8/2010 | Ohda et al. | |
| 7,843,293 | B1 * | 11/2010 | Bonjean et al. | 335/230 |
| 7,880,105 | B2 | 2/2011 | Hashimoto et al. | |
| 8,330,065 | B2 | 12/2012 | Ohda et al. | |
| 8,395,067 | B2 | 3/2013 | Marushima et al. | |
| 8,420,969 | B2 | 4/2013 | Marushima et al. | |
| 2004/0155740 | A1 * | 8/2004 | Nussio | 335/220 |
| 2008/0078666 | A1 * | 4/2008 | Ohda et al. | 200/400 |
| 2009/0201109 | A1 | 8/2009 | Hashimoto et al. | |
| 2010/0126967 | A1 * | 5/2010 | Ohda et al. | 218/154 |
| 2011/0000768 | A1 * | 1/2011 | Marushima et al. | 200/50.24 |
| 2011/0095852 | A1 * | 4/2011 | Niimi et al. | 335/184 |

FOREIGN PATENT DOCUMENTS

| | | |
|---|---|---|
| JP | 59-164115 | 11/1984 |
| JP | 1-142128 | 9/1989 |
| JP | 06-068775 | 3/1994 |
| JP | 06-333486 | 12/1994 |
| JP | 2529264 | 6/1996 |
| JP | 2007-323989 A | 12/2007 |
| JP | 4776425 B2 | 7/2011 |

OTHER PUBLICATIONS

U.S. Appl. No. 13/953,119, filed Jul. 29, 2013, Marushima et al.

Extended European Search Report issued Feb. 10, 2015 in Patent Application No. 12822340.1.

* cited by examiner

SWITCHGEAR AND OPERATION MECHANISM FOR THE SAME

CROSS REFERENCES TO RELATED APPLICATIONS

This application is a continuation-in-part (CIP) application based upon the International Application PCT/JP2012/005054, the International Filing Date of which is Aug. 8, 2012, the entire content of which is incorporated herein by reference, and claims the benefit of priority from the prior Japanese Patent Application No. 2011-174045, filed in the Japanese Patent Office on Aug. 9, 2011, the entire content of which is incorporated herein by reference.

FIELD

Embodiments of the present invention relates to a switchgear for opening and closing an electric circuit and an operation mechanism for the same.

BACKGROUND

Generally, operation mechanisms for switchgears include those using hydraulic operating power for providing a large output power and those using spring operating force for providing a low to middle output power. The former mechanisms are referred to as hydraulic operation mechanisms, while the latter mechanisms are referred to as spring operation mechanisms. Particularly, arc-extinguishing chambers of arc gas breakers, which are a sort of switchgear, have been downsized in recent years so that accidental electric currents and other fault electric currents can be cut-off with small operating force and hence spring operation mechanisms have been finding applications than ever. High-speed operation capabilities of providing a 2-cycle electric current cut-off effect (cutting an AC within the time of two cycles thereof) are required of gas circuit breakers for ultra-high voltages.

Japanese Patent No. 2,529,264, the entire content of which is incorporated herein by reference, describes a spring operation mechanism that can provide a 2-cycle electric current cut-off effect. The spring operation mechanism is designed to use torsion bars to provide drive force for turning on and off a switch. More specifically, the mechanism is formed as compact one by reciprocating two torsion bars to provide high-speed operation capabilities.

Japanese Patent Application Laid-Open Publication No. 2007-323989, the entire content of which is incorporated herein by reference, describes a spring operation mechanism that can adapt itself not only to 2-cycle electric current cut-off but also to other numbers of cut-off cycles such as 3-cycle cut-off and 5-cycle cut-off.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION

Figure 1:
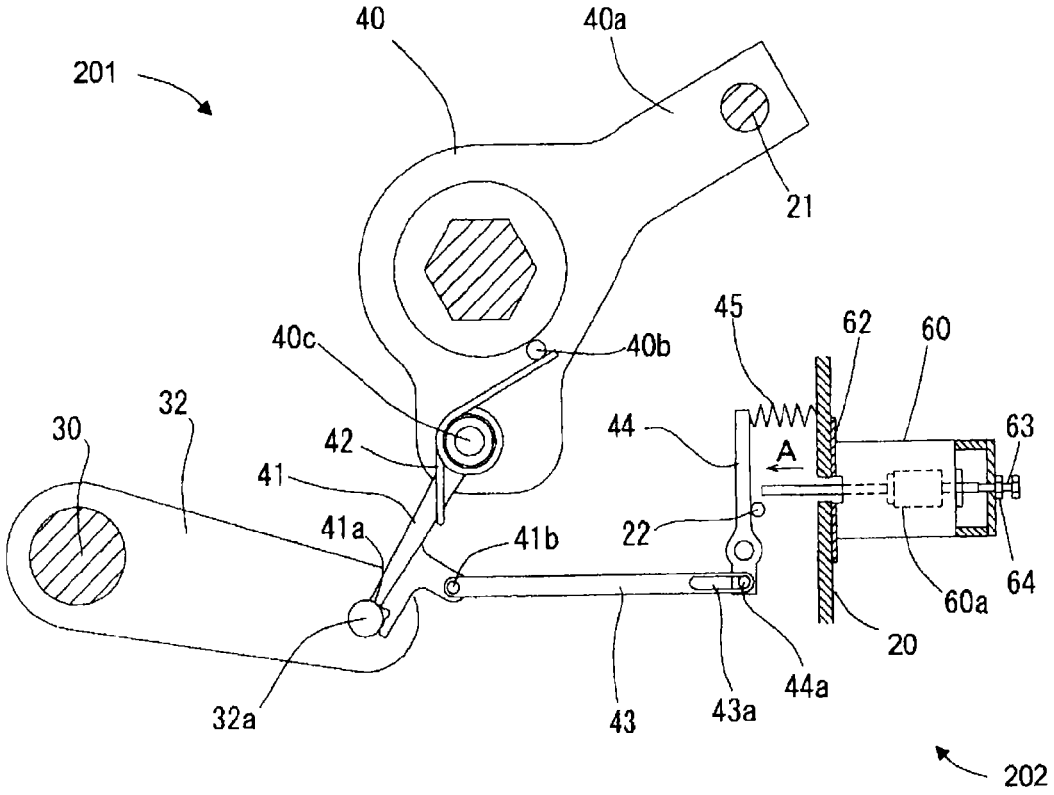
FIG. 1 is a schematic front view of the first embodiment of switchgear operation mechanism, showing the circuit opening trigger mechanism and the circuit opening operation section thereof in a closed circuit condition.

Spring operation mechanisms disclosed in Japanese Patent No. 2,529,264 and Japanese Patent Application Laid-Open Publication No. 2007-323989 as described above can provide a 2-cycle electric current cut-off effect. Particularly, a spring operation mechanism of Japanese Patent Application Laid-Open Publication No. 2007-323989 can adapt itself to lower speed electric current cut-offs such as 3-cycle electric current cut-off. However, the time to open an electric circuit varies from a spring operation mechanism to another due to dispersions in the characteristics of the component parts of such mechanisms and the influence of friction of link sections and sliding sections thereof so that each spring operation mechanism needs to be finely adjusted to make the time to open an electric circuit of a predetermined value. The spring operation mechanism disclosed in Japanese Patent No. 2,529,264 does not have such a fine adjustment feature. On the other hand, the spring operation mechanism disclosed in Japanese Patent Application Laid-Open Publication No. 2007-323989 requires a cumbersome operation for finely adjusting the magnetic coupling because the tripping operation section thereof needs to be replaced for fine adjustment and, while the spring operation mechanism uses a region having large attraction force of an electromagnetic solenoid for high-speed electric current cut-offs, the movable region of the movable iron core of the solenoid is small and practically provides no range of adjustability because the gap between the movable iron core and the fixed iron core is small.

Additionally, the time to close an electric circuit also can vary from a spring operation mechanism to another due to dispersions in the characteristics of the component parts of such mechanisms and the influence of friction of link sections and sliding sections thereof. For this reason, the time to close a 3-phase electric circuit can vary when the spring operation mechanism is employed for a breaker that can operate for circuits with different phases, although the spring operation mechanism does not have any feature of finely adjusting the time to close a circuit.

In view of the above-identified problems, it is therefore the object of the present invention to provide a switchgear for opening and closing an electric circuit that can be adjusted for at least either the time to open the circuit or the time to close the circuit in a simple and easy manner.

In order to achieve the object, according to an embodiment of the present invention, there is presented a switchgear operation mechanism for driving a movable contact to reciprocate so as to bring the switchgear from a closed circuit condition to an open circuit condition and vice versa. The mechanism comprises: a circuit opening spring that operates to open a circuit by discharging energy; a circuit opening trigger mechanism that maintains a state of energy accumulation of the circuit opening spring; a circuit opening operation section that releases the circuit opening trigger mechanism from constraint; a circuit closing spring that operates to close the circuit by discharging energy; a circuit closing trigger mechanism that maintains a state of energy accumulation of the circuit closing spring; and a circuit closing operation section that releases the circuit closing trigger mechanism from constraint. At least either the circuit opening operation section or the circuit closing operation section includes: an electromagnetic solenoid having a fitting structure provided with a step; and a solenoid spacer that adjusts a distance between the circuit opening trigger mechanism or the circuit closing trigger mechanism to be operated by the electromagnetic solenoid and the electromagnetic solenoid. The electromagnetic solenoid has: a solenoid housing fixed by way of the solenoid spacer; a plunger slidable relative to the solenoid housing; a plunger return spring urging the plunger in a plunger returning direction; a coil rigidly fitted to the solenoid housing to drive the plunger to slide in a direction of magnetic excitation operation opposite to the plunger returning direction against the urging force of the plunger return spring by generating a magnetically excited state by electric power supplied to the coil; and a stopper fitted to the solenoid housing so as to limit sliding motion of the plunger in the plunger returning direction when no electric power is supplied to the coil, limiting position thereof being adjustable.

In order to achieve the object, according to an embodiment of the present invention, there is presented a switchgear comprising: a movable contact; and a switchgear operation mechanism that drives the movable contact to reciprocate so as to bring the switchgear from a closed circuit condition to an open circuit condition and vice versa. The switchgear operation comprises: a circuit opening spring that operates to open a circuit by discharging energy; a circuit opening trigger mechanism that maintains a state of energy accumulation of the circuit opening spring; a circuit opening operation section that releases the circuit opening trigger mechanism from constraint; a circuit closing spring that operates to close the circuit by discharging energy; a circuit closing trigger mechanism that maintains a state of energy accumulation of the circuit closing spring; and a circuit closing operation section that releases the circuit closing trigger mechanism from constraint. At least either the circuit opening operation section or the circuit closing operation section includes: an electromagnetic solenoid having a fitting structure provided with a step; and a solenoid spacer that adjusts a distance between the circuit opening trigger mechanism or the circuit closing trigger mechanism to be operated by the electromagnetic solenoid and the electromagnetic solenoid. The electromagnetic solenoid has: a solenoid housing fixed by way of the solenoid spacer; a plunger slidable relative to the solenoid housing; a plunger return spring urging the plunger in a plunger returning direction; a coil fixed to the solenoid housing to drive the plunger to slide in a direction of magnetic excitation operation opposite to the plunger returning direction against the urging force of the plunger return spring by generating a magnetically excited state by electric power supplied to the coil; and a stopper fitted to the solenoid housing so as to limit sliding motion of the plunger in the plunger returning direction when no electric power is supplied to the coil, limiting position thereof being adjustable.

Now, embodiments of switchgear operation mechanism according to the present invention will be described by referring to the drawings.

First Embodiment

Firstly, the first embodiment of switchgear operation mechanism according to the present invention will be described by referring to FIGS. 1 through 9.

Figure 2:
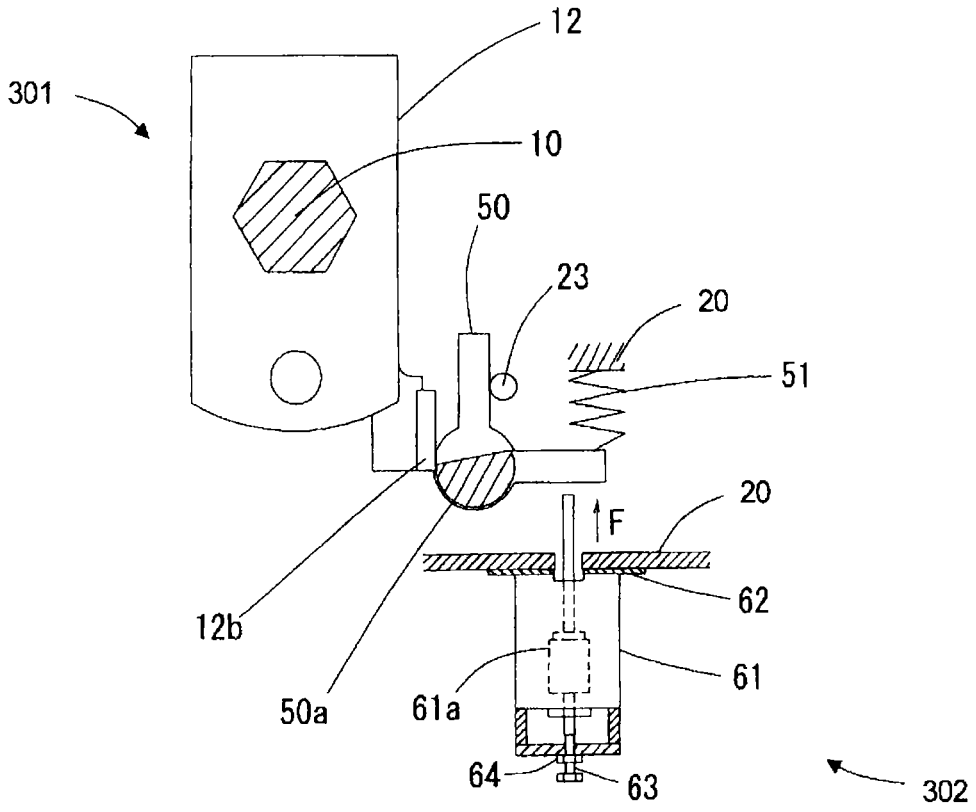
FIG. 2 is a schematic front view of the first embodiment of switchgear operation mechanism, showing the circuit closing trigger mechanism and the circuit closing operation section thereof in a state of completion of a circuit closing spring energy accumulation process.
Figure 3:
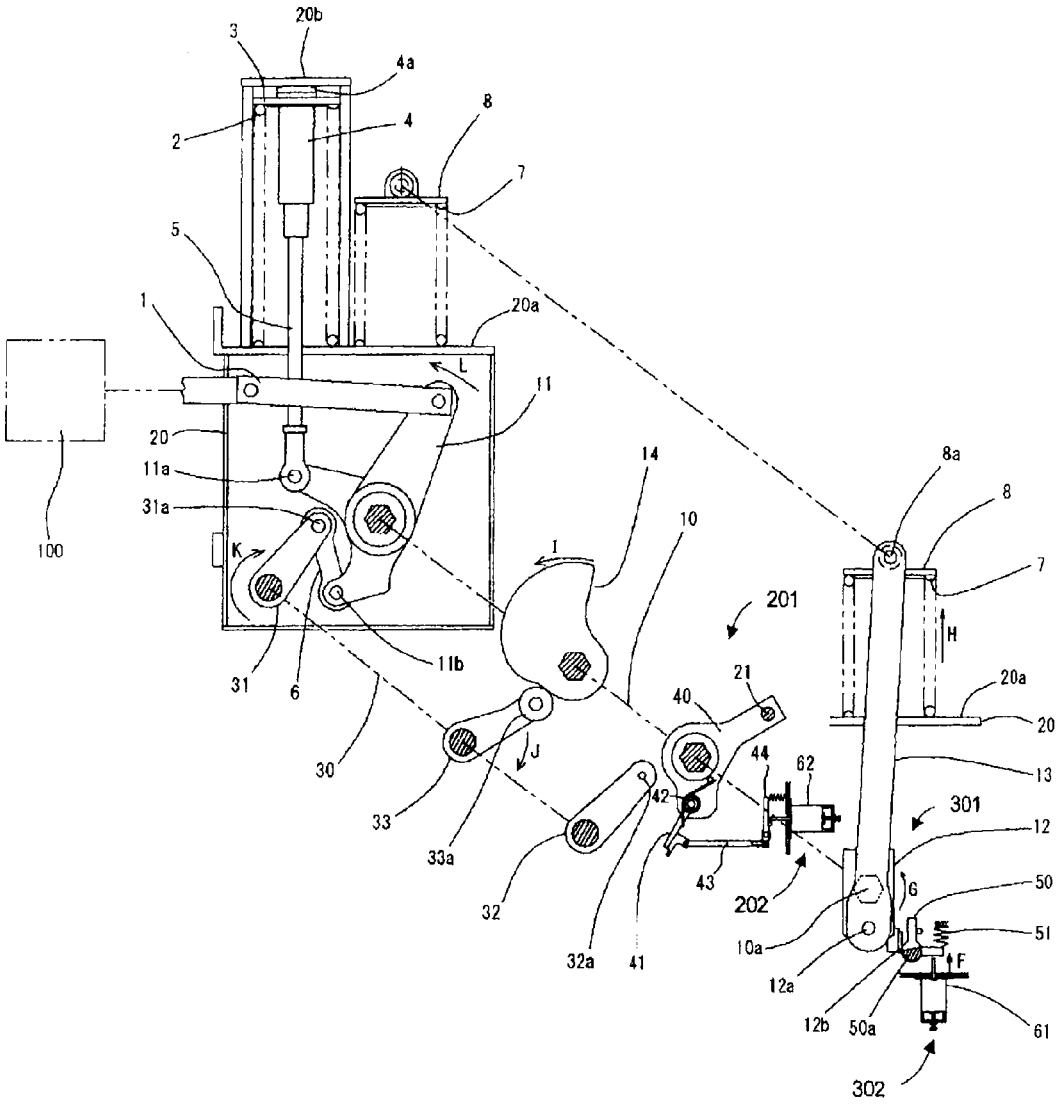
FIG. 3 is a schematic developed front view of the switchgear operation mechanism of FIGS. 1 and 2 in an open circuit condition.
Figure 4:
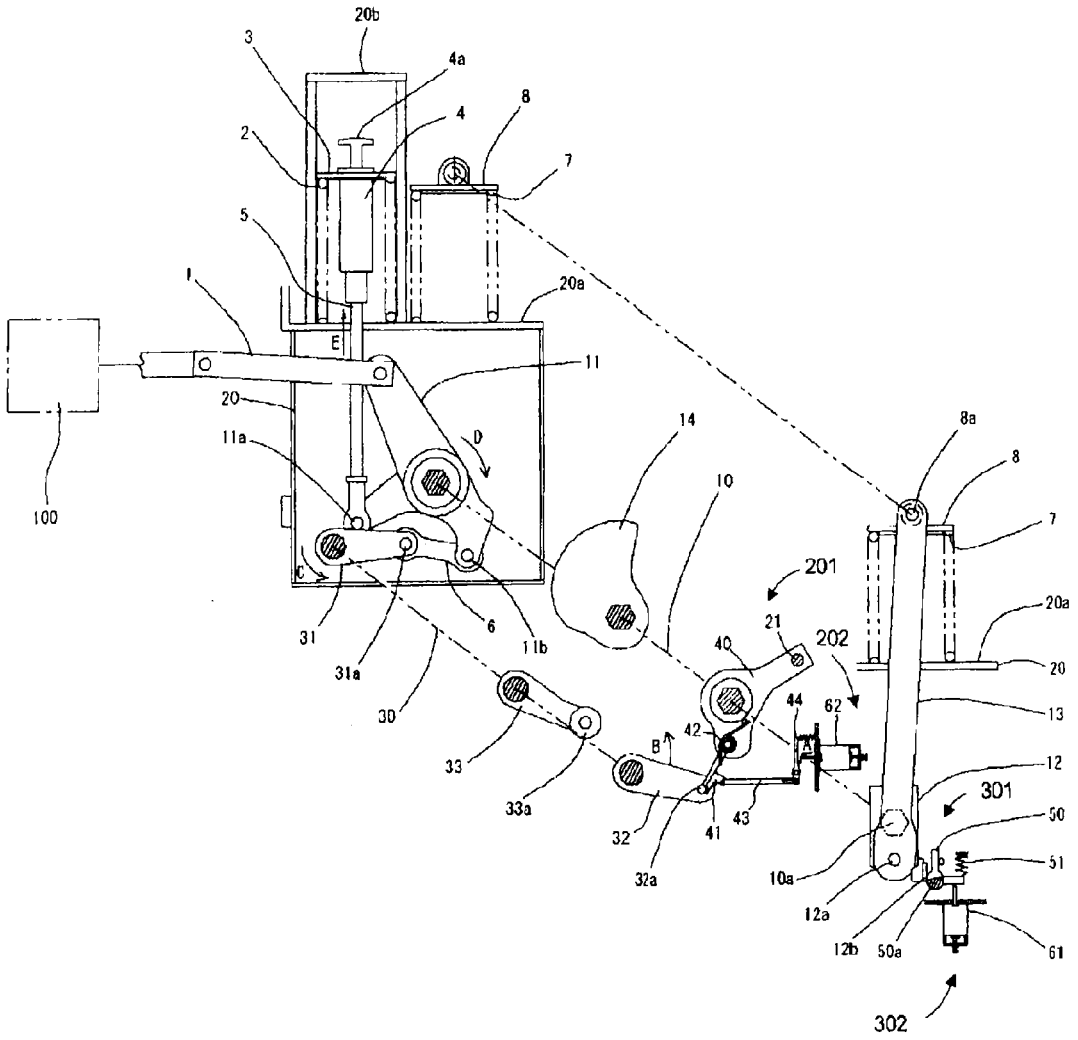
FIG. 4 is a schematic developed front view of the switchgear operation mechanism of FIGS. 1 and 2 in a closed circuit condition.
Figure 5:
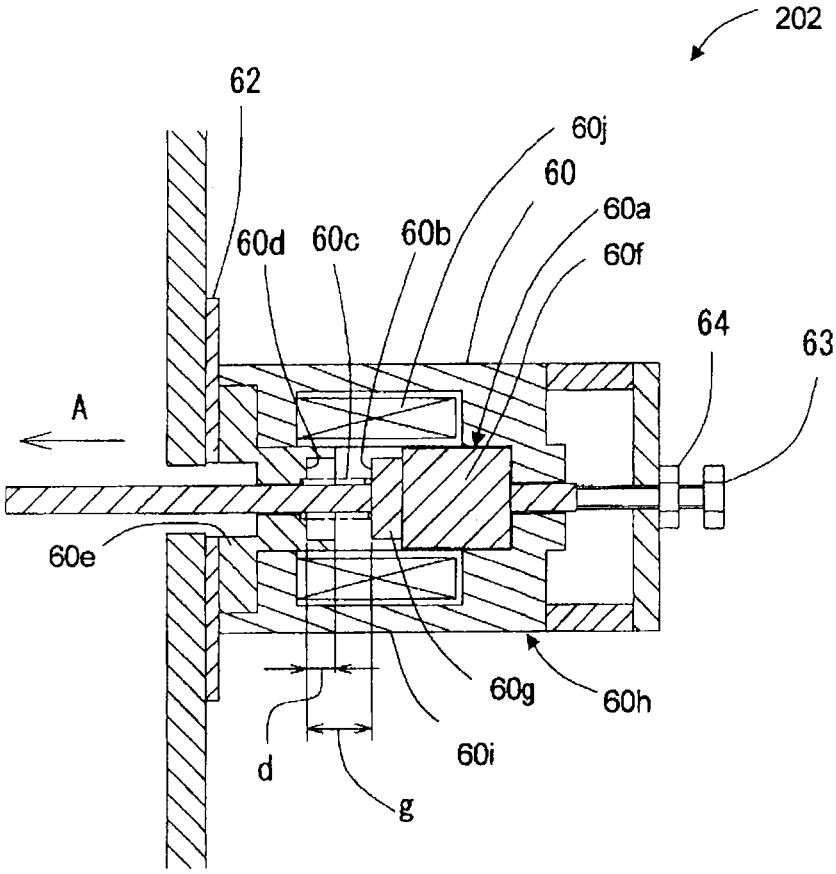
FIG. 5 is a schematic longitudinal cross-sectional view of the switchgear operation mechanism, showing the circuit opening operation section in an unexcited solenoid condition.
Figure 6:
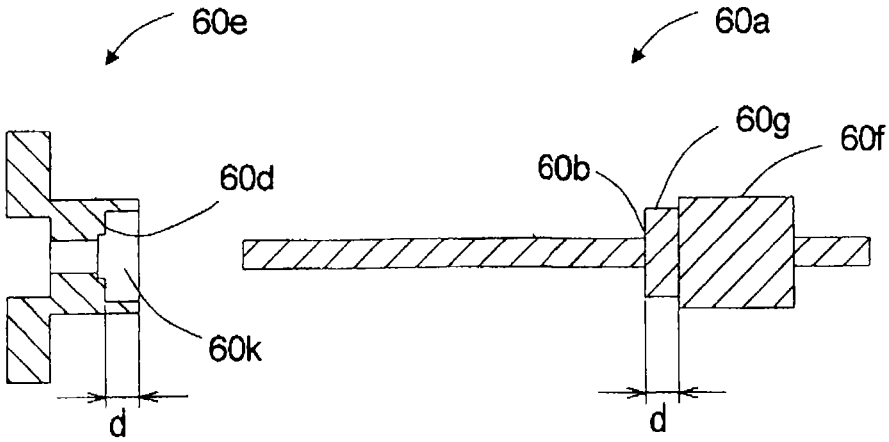
FIG. 6 is an exploded and enlarged schematic longitudinal cross-sectional view of the base and the plunger of FIG. 5 in an isolated state.

FIG. 1 is a schematic front view of the first embodiment of switchgear operation mechanism, showing the circuit opening trigger mechanism 201 and the circuit opening operation section 202 thereof in a closed circuit condition. FIG. 2 is a schematic front view of the first embodiment of switchgear operation mechanism, showing the circuit closing trigger mechanism 301 and the circuit closing operation section 302 thereof in a state of completion of a circuit closing spring energy accumulation process. FIG. 3 is a schematic developed front view of the switchgear operation mechanism of FIGS. 1 and 2 in an open circuit condition. FIG. 4 is a schematic developed front view of the switchgear operation mechanism of FIGS. 1 and 2 in a closed circuit condition. FIG. 5 is a schematic longitudinal cross-sectional view of the circuit opening operation section 202 in an unexcited solenoid condition. FIG. 6 is an exploded and enlarged schematic longitudinal cross-sectional view of the base 60*e* and the plunger 60*a* of the circuit opening electromagnetic solenoid of FIG. 5 in an isolated state.

Figure 7:
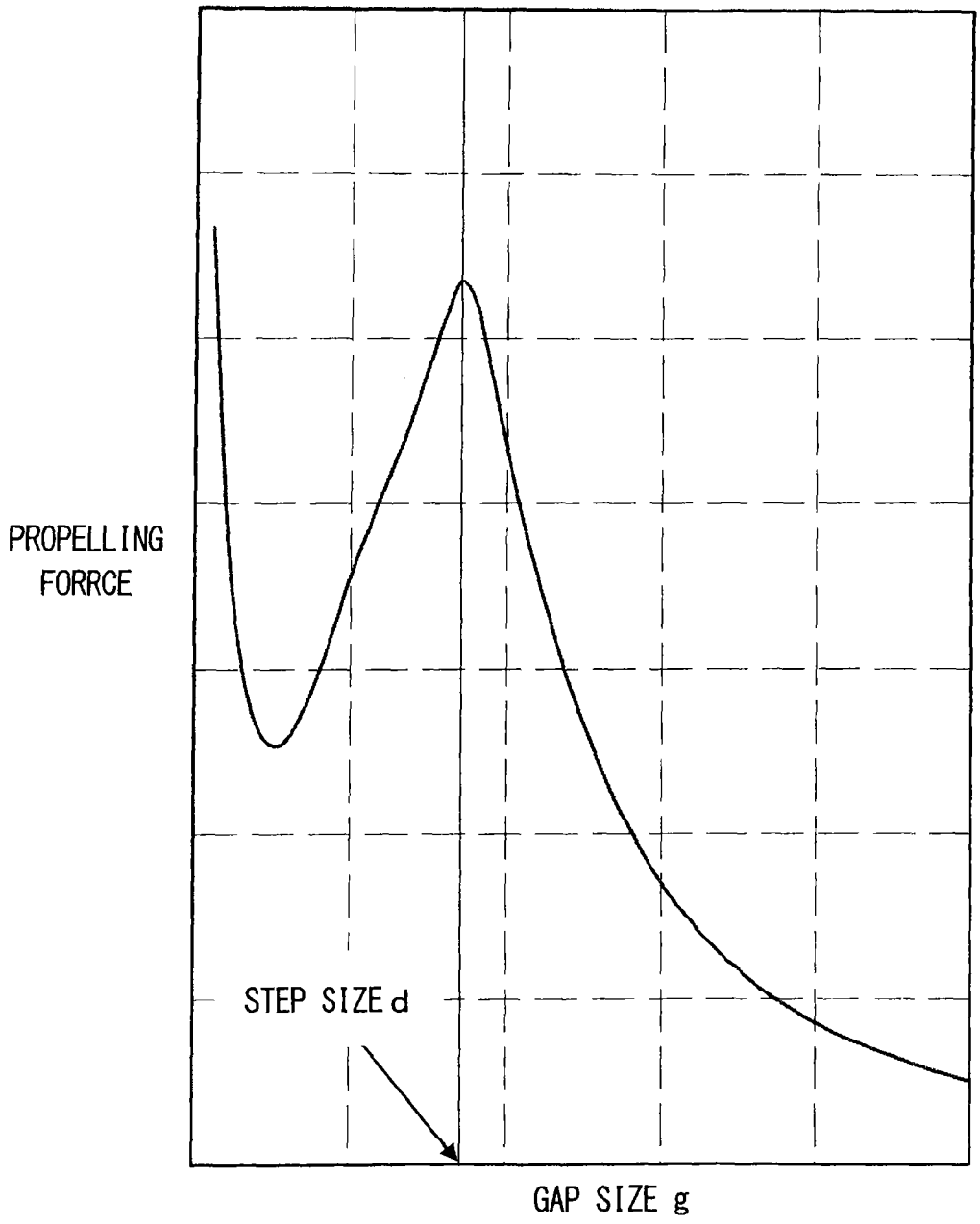
FIG. 7 is a graph illustrating the relationship between the gap size and the propelling force of the electromagnetic solenoid shown in FIGS. 5 and 6.
Figure 8:
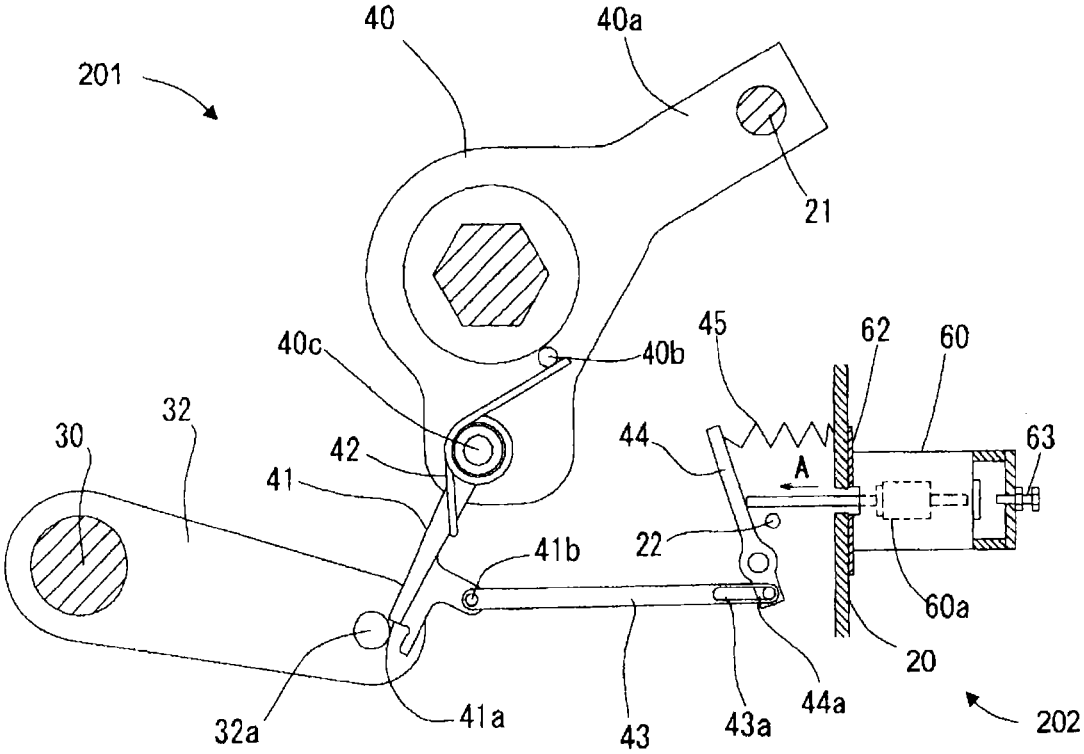
FIG. 8 is a schematic front view of the switchgear operation mechanism, showing the circuit opening trigger mechanism and the circuit opening operation section thereof in a condition of being on the way of circuit opening operation.
Figure 9:
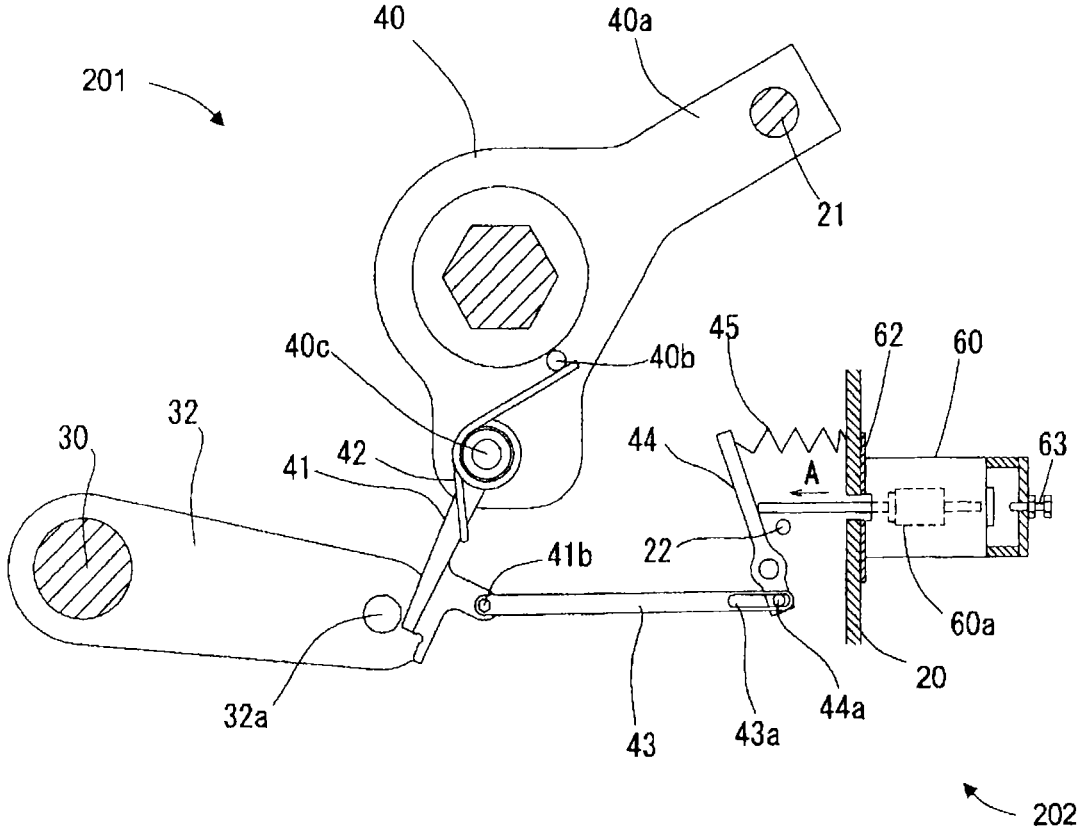
FIG. 9 is a schematic front view of the switchgear operation mechanism, showing the circuit opening trigger mechanism and the circuit opening operation section thereof in a condition of being on the way of circuit opening operation subsequent to the condition of FIG. 8.

FIG. 7 is a graph illustrating the relationship between the gap size g and the propelling force of the electromagnetic solenoid shown in FIGS. 5 and 6. FIG. 8 is a schematic front view of the switchgear operation mechanism, showing the circuit opening trigger mechanism and the circuit opening operation section thereof in a condition of being on the way of circuit opening operation. FIG. 9 is a schematic front view of the switchgear operation mechanism, showing the circuit opening trigger mechanism and the circuit opening operation section thereof in a condition of being on the way of circuit opening operation subsequent to the condition of FIG. 8.

Referring FIGS. 3 and 4, a movable contact 100 is linked to the left side of a link mechanism 1. The movable contact 100 is so arranged that it is opened to give rise to an open circuit condition when the link mechanism 1 is driven to move rightward as shown in FIG. 3 and closed to give rise to a closed circuit condition when the link mechanism 1 is driven to move leftward as shown in FIG. 4. The link mechanism 1 is rotatably engaged at an end thereof with the front end of a main lever 11. The main lever 11 is rotatably fitted to a circuit closing shaft 10. The circuit closing shaft 10 is rotatably supported by bearings (not shown) rigidly fitted to a frame (support structure) 20.

A circuit opening spring 2 is rigidly fitted at an end thereof to a fitting surface 20*a* and snugly fitted at the other end thereof into a circuit opening spring receiver 3. A damper 4 is firmly fixed to the circuit opening spring receiver 3. Liquid is sealed in the inside of the damper 4 and a piston 4*a* is translatably and slidably arranged. The damper 4 is firmly fixed at an end thereof to a circuit opening spring link 5. The circuit opening spring link 5 is rotatably fitted to a pin 11*a* of the main lever 11.

A sub shaft 30 is rotatably arranged at the frame 20 and a sub lever 31 is firmly fixed to the sub shaft 30. A pin 31*a* is arranged at the front end of the sub lever 31. A pin 11*b* is arranged at the sub lever 11 and linked to the pin 31*a* by means of a main-sub coupling link 6. A latch lever 32 is firmly fixed to the sub shaft 30 and a roller pin 32*a* is rotatably and snugly fitted to the front end thereof. Additionally, a cam lever 33 is firmly fixed to the sub shaft 30 and a roller 33*a* is rotatably and snugly fitted to the front end of the cam lever 33.

A circuit closing spring 7 is rigidly fitted at one end thereof to the fitting surface 20*a* and snugly fitted at the other end thereof into a circuit closing spring receiver 8. A pin 8*a* is arranged at the circuit closing spring receiver 8. The pin 8*a* is linked to a pin 12*a* of a circuit closing lever 12 that is firmly fixed to an end of a circuit closing shaft 10 by way of a circuit closing link 13. A circuit closing cam 14 is firmly fixed to the circuit closing shaft 10 and releasably brought into contact engagement with the roller 33*a* as the circuit closing shaft is driven to rotate.

As shown in FIG. 1, a projecting support section 40*a* is formed at a lock lever 40 and is engaged with pin 21 firmly fixed to the frame 20. Thus, the lock lever 40 is fixed to the frame 20.

A circuit opening trigger mechanism 201 is formed by a latch 41, a latch return spring 42, a pin 40*b*, a tripping link 43, a tripping lever 44, a tripping lever return spring 45 and a tripping lever stop pin 22. The latch 41 is arranged so as to be rotatable around a latch shaft pin 40*c* fixed to an end of the lock lever 40. A latch return spring 42 is arranged between the lock lever 40 and the latch 41. The latch return spring 42 is engaged at an end thereof with the pin 40*b* that is firmly fixed to the lock lever 40. The latch return spring 42 constantly generates torque for driving the latch to rotate clockwise. A front end 41*a* of the latch 41 is formed as a flat surface or as a convex circular arc surface of revolution (that is as a convex circular cylindrical surface) and the circular arc surface of revolution is so formed as that the center position thereof substantially falls on the straight line connecting the center of the roller pin 32*a* in a closed circuit condition and the center of the latch shaft pin 40*c*.

In the closed circuit condition shown in FIGS. 1 and 4, the front end 41*a* is engaged with the roller pin 32*a* and the roller pin 32*a* pushes the front end 41*a* toward the axis of rotation of the latch 41 so that the latch 41 can be structurally prevented from rotating counterclockwise.

As shown in FIG. 1, the tripping link 43 is provided with an oblong hole 43*a* formed at the part thereof that is engaged with the tripping lever pin 44*a* arranged at the tripping lever 44. The tripping lever pin 44*a* is movable and rotatable relative to the oblong hole 43*a* within the oblong hole 43*a*. A latch pin 41*b* that is arranged at the latch 41 is rotatably engaged with the end of the tripping link 43 on the side opposite to the oblong hole 43*a*. The tripping lever 44 is so arranged as to be rotatable relative to the frame 20 and torque for driving it to rotate clockwise is constantly applied to it by the tripping level return spring 45. Note, however, that the clockwise rotational motion of the tripping lever 44 is restricted as the tripping lever stop pin 22 firmly fixed to the frame 20 is engaged with the tripping lever 44. Additionally, in the open circuit condition shown in FIG. 3, the clockwise rotational motion of the latch 41 is restricted by the tripping lever stop lever 22 by way of the tripping link 43.

The circuit opening operation section 202 is formed by: a circuit opening electromagnetic solenoid 60 having a fitting structure that is provided with a step, a solenoid spacer 62, and a stopper 63. The solenoid spacer 62 is arranged between the frame 20 and the circuit opening electromagnetic solenoid 60. The position of the circuit opening solenoid 60 can arbitrarily be determined by varying the thickness of the solenoid spacer 62.

A through hole that is provided with a female screw is bored at an end portion of a solenoid housing 60*h* of the circuit opening electromagnetic solenoid 60. A stopper 63 on which a male screw is threaded so as to be screwed into the female screw is fitted to the solenoid housing 60*h*. A nut 64 is arranged so as to be screwed onto the male screw. Thus, the position of the stopper 63 can be fixed by tightening the nut 64.

The front end of the plunger 60*a* of the circuit opening electromagnetic solenoid 60 is releasably brought into contact engagement with the tripping lever 44. As circuit opening command is input, the front end of the plunger 60*a* of the circuit opening electromagnetic solenoid 60 pushes the tripping lever 44 and drives the tripping lever 44 to rotate counterclockwise.

As shown in FIG. 2, the circuit closing trigger mechanism 301 is formed by a circuit closing lock lever 50, a circuit closing lock lever return spring 51, a circuit closing lock lever stop pin 23 and a circuit closing lever 12. A ratchet pawl 12*b* is arranged at an end of the circuit closing lever 12. The ratchet pawl 12*b* is releasably held in contact engagement with a semicircular cylindrical section 50*a* arranged at the circuit closing lock lever 50 that is rotatably arranged at the frame 20.

The circuit closing lock lever return spring 51 is arranged at an end of the circuit closing lock lever 50, and the other end of the circuit closing lock lever return spring 51 is fixed to the frame 20. The circuit closing lock lever return spring 51 is a compression spring and constantly exerts torque for driving the circuit closing lock lever 50 to rotate clockwise. However, the rotary motion of the circuit closing lock lever 50 is restricted, since the circuit closing lock lever stop pin 23 that is firmly fixed to the frame 20 is engaged with it.

Like the circuit opening operation section 202, the circuit closing operation section 302 is formed by: a circuit opening electromagnetic solenoid 61 having a fitting structure that has a step, a solenoid spacer 62, and a stopper 63. The solenoid spacer 62 is arranged between the frame 20 and the circuit opening electromagnetic solenoid 61. The position of the circuit opening solenoid 61 can arbitrarily be determined by varying the thickness of the solenoid spacer 62. The circuit closing electromagnetic solenoid 61 is provided at an end thereof with a stopper 63 for determining the position of the plunger 61*a* of the circuit closing electromagnetic solenoid 61 in an magnetically unexcited state. The position of the stopper 63 can be arbitrarily determined.

Referring to FIG. 2, the stopper 63 is provided with a male screw and its position is fixed by means of a nut 64. The front end of the plunger 61*a* of the circuit closing electromagnetic solenoid 61 is releasably held in contact engagement with the circuit closing lock lever 50. As a circuit closing command is input, the front end of the plunger 61*a* of the circuit closing electromagnetic solenoid 61 pushes the circuit closing lock lever 50 and drives the circuit closing lock lever 50 to rotate counterclockwise.

As shown in FIG. 5, a plunger return spring 60*c* is arranged in the inside of the circuit opening electromagnetic solenoid 60 of the circuit opening operation section 202 so as to push an end facet 60*b* of the plunger 60*a* and urges the plunger 601 to the position for bringing it into a magnetically unexcited state.

The circuit opening electromagnetic solenoid 60 has a fitting structure that has a step.

More specifically, the plunger 60*a* has a circularly cylindrical plunger main body 60*f*, and a circularly cylindrical step section 60*g* having a diameter smaller than the plunger main body 60*f*. The step section 60*g* is fixed to the end facet of the plunger 60*a* of the plunger main body 60*f* at the front end side thereof. The plunger return spring 60*c* is held in contact with and pushes the end facet of the step section 60*g*.

The plunger 60*a* and the plunger return spring 60*c* are supported by a solenoid housing 60*h*. The solenoid housing 60*h* can be separated into a base 60*e* and a housing main body 60*i*. A coil 60*j* is arranged at a position in the housing main body 60*i* located facing to the plunger 60*a* so as to surround the outer periphery of the plunger 60*a*. The circuit opening electromagnetic solenoid 60 is magnetically excited as electric power is supplied to the coil 60*j*.

Both the housing main body 60*i* and the base 60*e* are fitted to the frame 20 by way of the solenoid spacer 62.

As shown in FIG. 6, a recess 60*k* is formed in the base 60*e* to accommodate the step section 60*g* when the circuit opening electromagnetic solenoid 60 is magnetically excited. The length of the step section 60*g* in the axial direction thereof is the step size, which is equal to the depth of the recess 60*k*.

FIG. 7 shows a graph illustrating the relationship between the gap size g between the end facet 60*b* of the step section 60*g* of the plunger 60*a* and an operation end position 60*d* and the propelling force of the circuit opening electromagnetic solenoid 60. As seen from the graph, as the circuit opening electromagnetic solenoid 60 is magnetically excited, the plunger 60*a* is attracted in the direction of arrow A in FIG. 5 to reduce the gap size g and, as the gap size g is reduced and comes closer to the step size d, the propelling force increases. As the gap size g is reduced further to become smaller than the step size d, the propelling force decreases but then increases near the operation end position to get to the largest value at the operation end position (the position where the gap size g is equal to 0).

The propelling force that is obtained when the plunger 60*a* and the tripping lever 44 are engaged with each other can be changed by shifting the position of the plunger 60*a* by means of the stopper and also by shifting the position of the circuit opening electromagnetic solenoid 60 by varying the thickness of the solenoid spacer 62. Then, as a result, it is possible to change the timing of releasing the circuit opening trigger mechanism 201 from constraint. The thickness of the solenoid spacer 62 can be varied by selectively using solenoid spacers 62 having different thicknesses or by using a variable number of solenoid spacers 62.

The circuit closing operation section 302 has a structure similar to that of the circuit opening operation section 202. Therefore, the propelling force that is obtained when the plunger 61*a* and the circuit closing lock lever 50 are engaged with each other can be changed by shifting the position of the plunger 61*a* of the circuit closing electromagnetic solenoid 61 by means of the stopper 63 and also by shifting the position of the circuit closing electromagnetic solenoid 61 by varying the thickness of the solenoid spacer 62. Then, as a result, it is possible to change the timing of releasing the circuit closing trigger mechanism 301 from constraint.

Since the structure of the circuit closing electromagnetic solenoid 61 is similar to that of the circuit opening electromagnetic solenoid 60 shown in FIG. 5, it will not be illustrated and described in detail.

In an open circuit condition as shown in FIG. 3, the center 10*a* of the circuit closing shaft 10 is located left relative to the center axis of the circuit closing link 13 (the axis connecting the center of the pin 8*a* and that of the pin 12*a*). Thus, as a result, a counterclockwise running torque is applied to the circuit closing lever 12 by the circuit closing spring 7. However, the circuit closing lever is held stationary and prevented from rotating due to the engagement of the ratchet pawl 12*b* and the semicircular cylindrical section 50*a*.

In a closed circuit condition as shown in FIG. 4, on the other hand, a clockwise running torque is constantly being applied to the main lever 11 due to the spring force of the circuit opening spring 2 urged to expand. The force transmitted to the main lever 11 is then transmitted to the sub lever 31 by way of the main-sub coupling link 6. The force is turned into a running torque constantly driving the sub lever 31 to rotate counterclockwise. At the same time, it is also urged to drive the latch lever 32 to rotate counterclockwise. The counterclockwise rotational motion of the latch lever 32 is restricted because the front end 41*a* of the latch 41 and the roller pin 32*a* are engaged with each other in a closed circuit condition, and hence the downstream members from the sub lever 31 to the circuit opening spring 2 are held stationary.

In the illustrated embodiment, the axes of rotation of the circuit closing shaft 10, the sub shaft 30 and so on and the axes of the pins run in parallel with one another.

(Circuit Opening Operation)

Now, the circuit opening operation of this embodiment, which has the above-described configuration, from a closed circuit condition shown in FIGS. 1 and 4 to an open circuit condition shown in FIG. 3 by way of the conditions shown in FIGS. 8 and 9 will be described below.

Firstly, as a circuit opening command is externally input in a closed circuit condition as shown in FIGS. 1 and 4, the circuit opening electromagnetic solenoid 60 of the circuit opening operation section 202 is magnetically excited and the plunger 60*a* is driven to move in the direction of arrow A.

The tripping lever 44 is driven to rotate counterclockwise because it is engaged with the plunger 60*a*. Then, the tripping link 43 is driven to move rightward, while being held in engagement with the latch pin 41*b*, in an interlocked manner to consequently drive the latch 41 to rotate counterclockwise. As a result of this operation, the front end 41*a* of the latch 41 is disengaged from the roller pin 32*a*. FIG. 8 shows this condition.

Since counterclockwise rotational force is applied to the latch lever 32 by the circuit opening spring 2, it rotates counterclockwise, pushing away the latch 41. As this time, since the tripping link 43 moves, holding its oblong hole 43*a* in engagement with the tripping lever pin 44*a*, it moves independently from the tripping lever 44. FIG. 9 shows this condition.

FIG. 3 shows the condition of the end of a circuit opening operation. The tripping link 43 and the tripping lever 44 are restored to the respective substantially same positions as in a closed circuit condition (FIGS. 1 and 4) by the tripping lever return spring 45 (FIG. 1). The latch 41 is also restored to the substantially same position as in a closed circuit condition (FIGS. 1 and 4) by the latch return spring 42 (FIG. 1).

Referring to FIG. 4, as the latch 41 is disengaged from the roller pin 32*a*, the latch lever 32, the cam lever 33 and the sub lever 31 firmly fixed to the sub shaft 30 are driven to rotate counterclockwise (in the direction of arrows B and C. Then, the main lever 11 is driven to rotate clockwise (in the direction of arrow D) and both the circuit opening spring 2 and the damper 4 move in the direction of arrow E. The link mechanism 1 and the movable contact 100 linked to it move rightward to start a circuit opening operation.

When the circuit opening spring 2 is displaced by a certain distance, the piston 4*a* contacts the stopper 20*b* firmly fixed to the frame 20, and the damper 4 generates braking force to stop the motion of the circuit opening spring 2 and also the motions of the link levers coupled to it to complete the circuit opening operation. FIG. 3 shows this condition state.

(Circuit Closing Operation)

Now, the circuit closing operation from the state of completion of an energy accumulation process of the circuit closing spring 7 in an open circuit condition as shown in FIGS. 2 and 3 to a closed circuit condition as shown in FIGS. 1 and 4.

Referring to FIGS. 2 and 3, as an external command is input, the circuit closing electromagnetic solenoid 61 is magnetically excited and the plunger 61*a* is driven to move in the direction of arrow F so that the circuit closing lock lever 50 is driven to rotate counterclockwise because it is held in engagement with the plunger 61*a*. Then, the semicircular cylindrical section 50*a* is disengaged from the ratchet pawl 12*b*, and both the circuit closing lever 12 and the circuit closing shaft 10 are driven to rotate counterclockwise by the spring force of the circuit closing spring 7 (in the direction of arrow G), so that the circuit closing spring 7 is allowed to expand in the direction of arrow H to discharge energy. The circuit closing cam 14 firmly fixed to the circuit closing shaft 20 is driven to rotate in the direction of arrow I to become engaged with the roller 33*a*. As the roller 33*a* is pushed by the circuit closing cam 14, the cam lever 33 is driven to rotate clockwise (in the direction of arrow J) and, at the same time, the sub lever 31 is driven to rotate in the direction of arrow K.

The rotational motion of the sub lever 31 is transmitted to the main lever 11 and the main lever 11 is driven to rotate counterclockwise (in the direction of arrow L). Then, the link mechanism 1 and the movable contact 100 linked to it are driven to move leftward to execute a circuit closing operation. As the main lever 11 is driven to rotate, the circuit opening spring 2 is compressed to accumulate energy and the roller pin 32*a* becomes engaged with the latch 41 once again to complete the circuit closing operation. FIGS. 1 and 4 shows a state of completion of a circuit closing operation.

Thus, this embodiment can change the time period to open a circuit and/or the time period to close a circuit by means of a simple and easy adjustment method, and hence it can adapt itself with ease not only to 2-cycle electric current cut-off but also to other numbers of cut-off cycles such as 3-cycle cut-off and 5-cycle cut-off. Additionally, if there is a time lag to close a 3-phase electric circuit, it can be corrected with ease.

Second Embodiment

Figure 10:
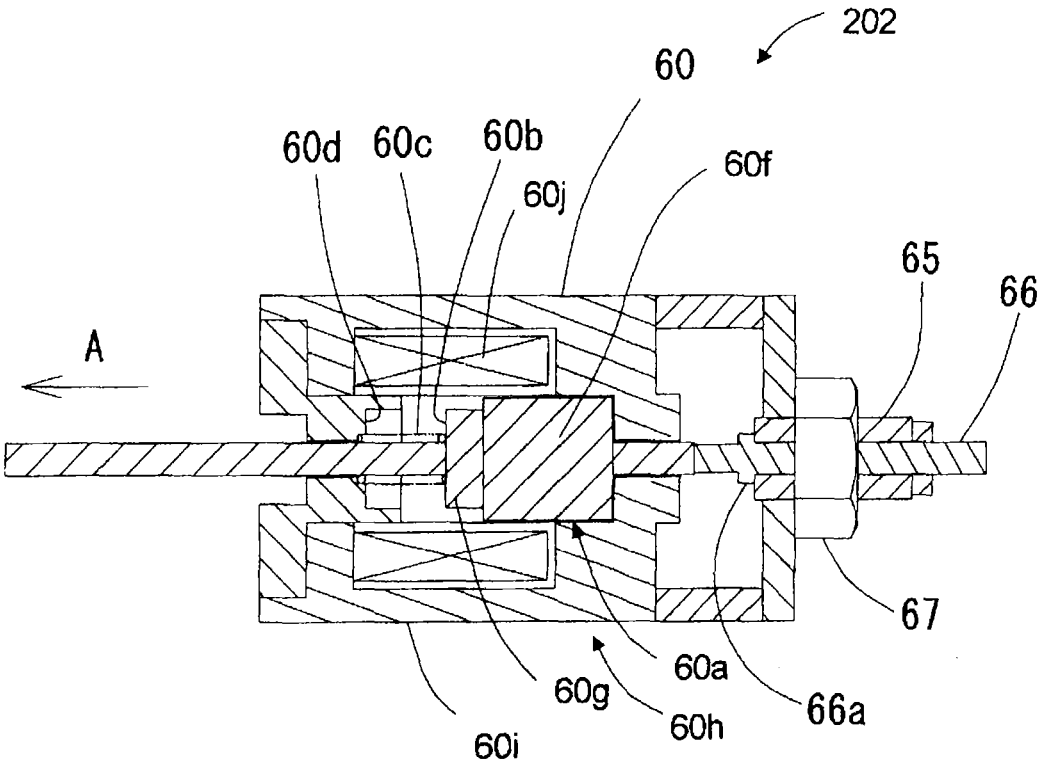
FIG. 10 is a schematic longitudinal cross-sectional view of the circuit opening operation section of the second embodiment of switchgear operation mechanism according to the present invention.

FIG. 10 is a schematic longitudinal cross-sectional view of the circuit opening operation section of the second embodiment of switchgear operation mechanism according to the present invention. The components of this embodiment same as or similar to those of the first embodiment are denoted respectively by the same reference symbols and will not be described repeatedly.

In this embodiment, the stopper 63 as shown in FIG. 5 is formed in a manner as described below.

A housing through hole is bored through an end portion of the solenoid housing 60*h* of circuit opening electromagnetic solenoid 60 and a housing female screw is formed at the housing through hole. A guide male screw formed on the outer periphery of the stopper guide 65 is screwed and inserted into the housing female screw. A stopper guide 65 is provided with a guide through hole and a stopper pin 66 is slidably arranged in the guide through hole. A projecting section 66*a* of the stopper pin 66 is formed in the solenoid housing 60*h* and the projecting section 66*a* is engaged with the stopper guide 65. The position of the stopper pin 66 is fixed as the guide male screw section formed on the outer periphery of the stopper guide 65 is screwed into a nut 67.

In this embodiment having the above-described configuration, the circuit opening trigger mechanism 201 and the circuit closing trigger mechanism 301 can be released from constraint by a simple manual operation of pushing the stopper pin 66 without requiring any additional manual operation section. Thus, space-saving is achieved by this embodiment.

Additionally, the circuit closing operation section 302 can be made to have a structure similar to that of the circuit opening operation section 202 to provide similar advantages.

Third Embodiment

Figure 11:
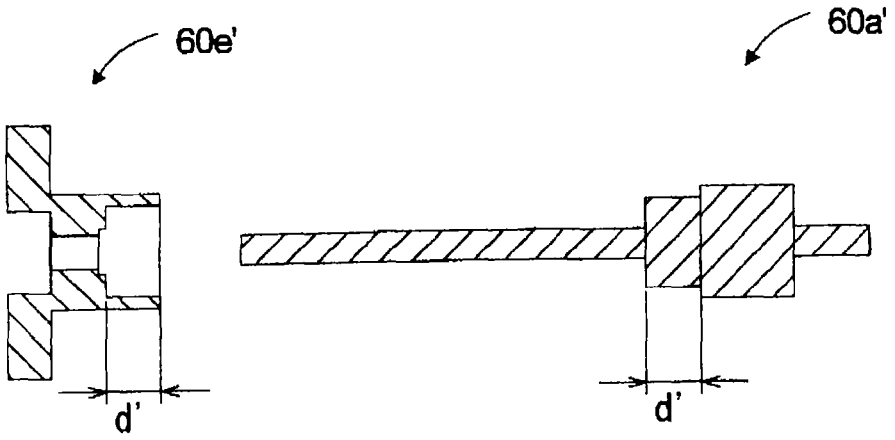
FIG. 11 is an exploded and enlarged schematic longitudinal cross-sectional view of the base and the plunger of the circuit opening electromagnetic solenoid of switchgear operation mechanism of the third embodiment of the present invention in an isolated state.
Figure 12:
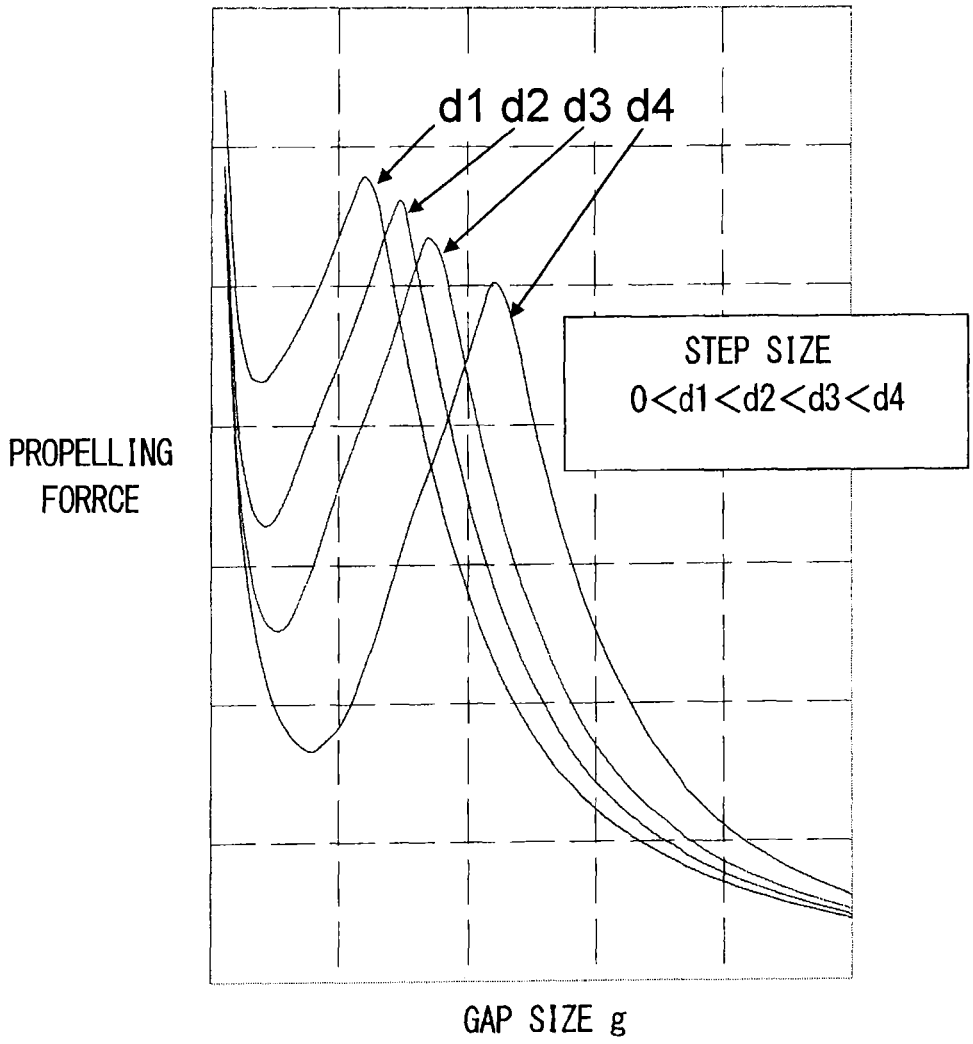
FIG. 12 is a graph illustrating the relationship between the gap size and the propelling force of the electromagnetic solenoid for different step sizes.

FIG. 11 is an exploded and enlarged schematic longitudinal cross-sectional view of the base and the plunger of the circuit opening electromagnetic solenoid of switchgear operation mechanism of the third embodiment of the present invention in an isolated state. FIG. 12 is a graph illustrating the relationship between the gap size and the propelling force of the electromagnetic solenoid for different step sizes. Note that the components of this embodiment same as or similar to those of the first embodiment are denoted respectively by the same reference symbols and will not be described repeatedly.

As seen from FIG. 12, the propelling force changes its characteristic depending on the step size. Therefore, in this embodiment, in addition to the set of the plunger 60*a* and the base 60*e* of the first embodiment, another set of a plunger 60*a*' having a step size different from that of the plunger 60*a* and a base 60*e*' is provided. Thus, the propelling force can be changed in its characteristic by allowing the sets to be replaced with each other. Thus, the timing of releasing the circuit opening trigger mechanism 201 from constraint can be changed, so that the time to open an electric circuit can be altered in a simple manner.

Additionally, the circuit closing electromagnetic solenoid can be made to have a similar structure. Thus, the timing of releasing the circuit opening trigger mechanism 301 from constraint can be changed, so that the time to open an electric circuit can be altered in a simple manner.

Fourth Embodiment

Figure 13:
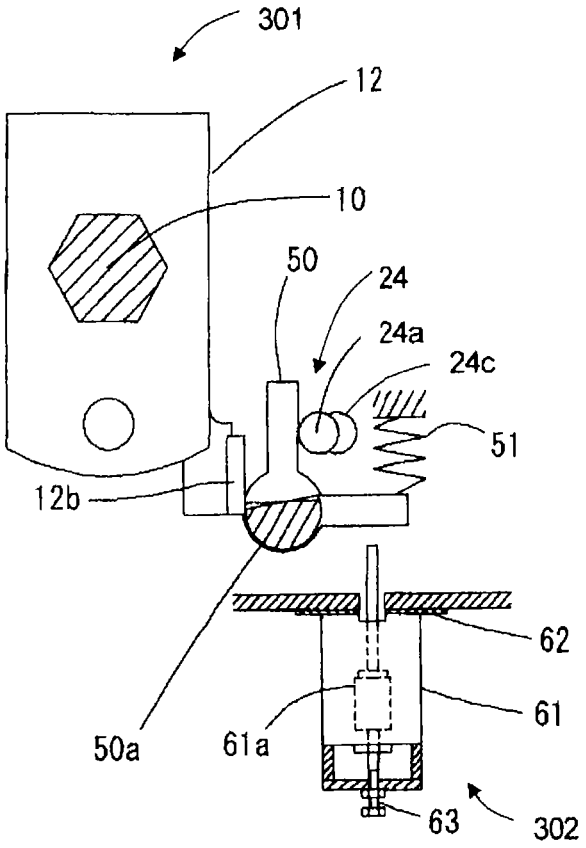
FIG. 13 is a schematic front view of the fourth embodiment of switchgear operation mechanism, showing the circuit opening trigger mechanism and the circuit opening operation section thereof, showing the state of energy accumulation in the circuit closing spring.
Figure 14:
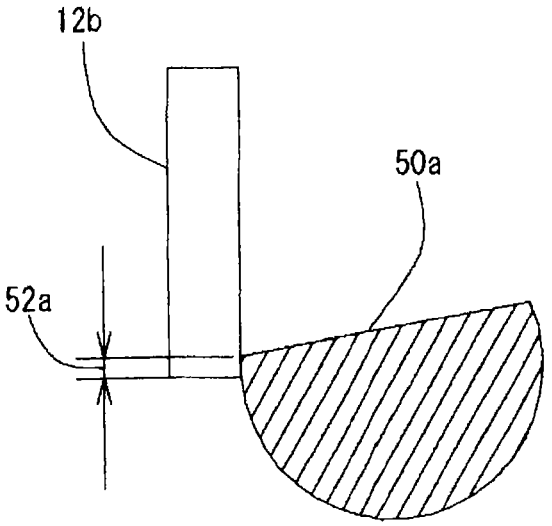
FIG. 14 is an enlarged front view of the ratchet pawl and the semicircular cylinder section in FIG. 13.
Figure 15:
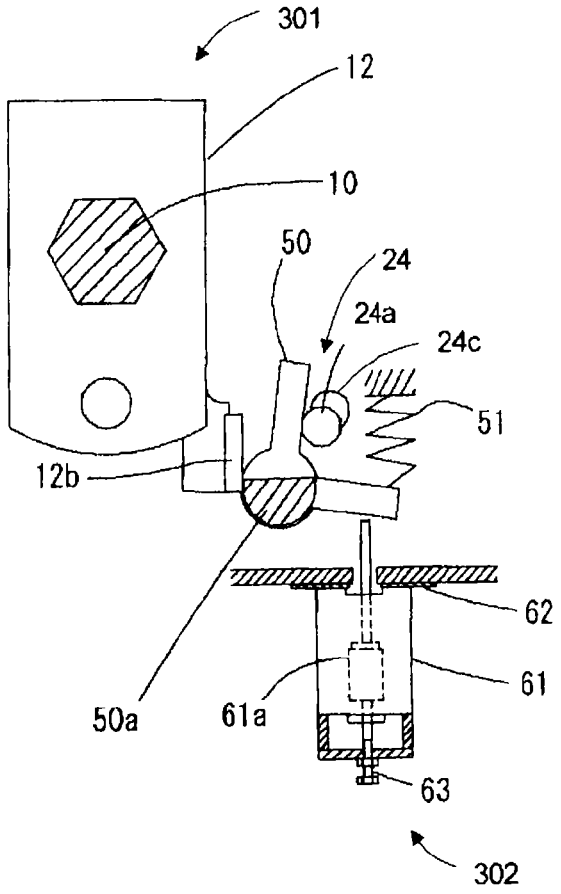
FIG. 15 is a schematic front view of the circuit closing trigger mechanism and the circuit closing operation section of the switchgear operation mechanism of FIG. 13, showing the circuit closing trigger mechanism and the state of energy accumulation in the circuit closing spring when the circuit closing lock lever stop pin thereof is turned to some extent.
Figure 16:
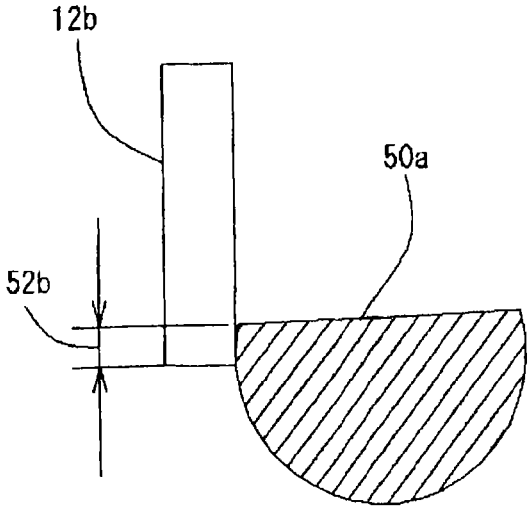
FIG. 16 is an enlarged schematic front view of the ratchet pawl and the semicircular cylinder section in FIG. 15.
Figure 17:
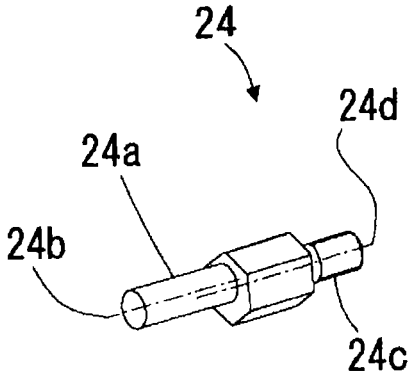
FIG. 17 is a schematic perspective view of the circuit closing lock lever stop pin in FIGS. 13 and 15 in an isolated state.
Figure 18:
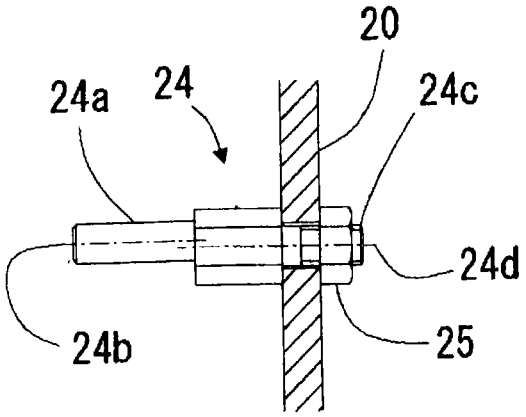
FIG. 18 is a schematic longitudinal cross-sectional view of the circuit closing lock lever stop pin in FIGS. 13, 15 and 17 in a state of being fitted to the frame.

FIG. 13 is a schematic front view of the fourth embodiment of switchgear operation mechanism, showing the circuit opening trigger mechanism and the circuit opening operation section thereof, showing the state of energy accumulation in the circuit closing spring. FIG. 14 is an enlarged front view of the ratchet pawl and the semicircular cylinder section in FIG. 13. FIG. 15 is a schematic front view of the circuit closing trigger mechanism and the circuit closing operation section of the switchgear operation mechanism of FIG. 13, showing the circuit closing trigger mechanism and the state of energy accumulation in the circuit closing spring when the circuit closing lock lever stop pin thereof is turned to some extent. FIG. 16 is an enlarged schematic front view of the ratchet pawl and the semicircular cylinder section in FIG. 15. FIG. 17 is a schematic perspective view of the circuit closing lock lever stop pin in FIGS. 13 and 15 in an isolated state. FIG. 18 is a schematic longitudinal cross-sectional view of the circuit closing lock lever stop pin in FIGS. 13, 15 and 17 in a state of being fitted to the frame.

Note that the components of this embodiment same as or similar to those of the first embodiment are respectively denoted by the same reference symbols and will not be described repeatedly.

In this embodiment, the circuit closing lock lever stop pin 23 shown in FIG. 2 is replaced by an eccentric pin 24. As shown in FIG. 17, the axial center 24*d* of the anchoring side shaft 24*c* of the eccentric pin 24 where a male screw is formed to fix the pin to the frame 20 is shifted relative to the axial center 24*b* of the engaging side shaft 24*a* thereof for engaging the pin with the circuit closing lock lever 50. Additionally, as shown in FIG. 18, the anchoring side shaft 24*c* of the eccentric pin 24 is rotatably inserted into a through hole of the frame 20, and the rotation thereof is fixed by a nut 25 at an arbitrarily selected angle.

With this embodiment having the above-described configuration, the engaging side shaft 24*a* of the eccentric pin 24 becomes eccentric and driven to rotate as the anchoring side shaft 24 rotates so that the circuit closing lock lever 50 is also driven to rotate to consequently change the range of engagement between the semicircular cylindrical section 50*a* of the circuit closing lock lever 50 and the ratchet pawl 12*b* of the circuit closing lever 12.

Thus, the timing of releasing the circuit closing trigger mechanism 301 from constraint and the time to close a circuit can be changed by a simple and easy adjustment method of fixing the eccentric pin 24 at an arbitrarily selected angle by means of the nut 25.

FIGS. 13 and 15 show the circuit closing trigger mechanism 301 and the circuit closing operation section 302 at different angles of the eccentric pin 24, and FIGS. 14 and 16 show the area of engagement of the ratchet pawl 12*b* and the semicircular cylindrical section 50*a* in detail. In the illustrated instance, since the range of an engagement 52*a* in FIG. 14 is broader than the range of an engagement 52*b* in FIG. 16, the time to disengage the ratchet pawl 12*b* and the semicircular cylindrical section 50*a* from each other and hence the time to close a circuit is longer in FIG. 15.

Advantages similar to those of the eccentric pin of the circuit closing trigger mechanism 301 can be obtained at the circuit opening trigger mechanism 201 by using an eccentric pin for the tripping lever stop pin 22 that is engaged with the tripping lever 44.

Similar advantages can also be obtained by changing the diameter of the tripping lever stop pin 22 or the circuit closing lock lever stop pin 23.

OTHER EMBODIMENTS

While the present invention is described above by way of several embodiments, these embodiments are described only as exemplary embodiments and do not limit the scope of the present invention by any means. Furthermore, the present invention can be embodied in various different ways and such embodiments can be subjected to various omissions, replacements and alterations without departing from the spirit and scope of the present invention. Thus, such embodiments and their modifications are equally within the spirit and scope of the present invention, particularly as defined in the appended claims and their equivalents.

For example, while compression springs are employed for the circuit opening spring 2 and the circuit closing spring 7 in each of the above-described embodiments, they may be replaced by some other elastic elements such as torsion coil springs, disc springs, spiral springs, leaf springs, air springs or extension springs. Additionally, while coil springs or torsion coil springs are employed for the latch return spring 42, the tripping lever return spring 45, the circuit closing lock lever return spring 51 and the plunger return spring 60*c* provided for the latch 41, the tripping lever 44, the closing circuit lock lever 50 and the circuit opening electromagnetic solenoid 60, they may be replaced by some other elastic elements such as disc springs, spiral springs or leaf springs.

Furthermore, the above statement is applicable to operation devices having a plurality of circuit opening springs and those having a plurality of circuit closing springs.

Since the lock lever is fixed to the frame 20, the lock lever may be omitted and the pin 40*b* may be directly fixed to the frame 20. Alternatively, the pin 40*b* may be integrally formed with the lock lever 40 or the frame 20.

Although the solenoid spacers 62 of the circuit opening operation section 202 and the solenoid spacers 62 of the circuit closing operation section 302 are denoted by the same reference symbols of "62", spacers having different thicknesses may be employed depending on the required operation time.

The timing of releasing the circuit opening trigger mechanism 201 and that of releasing the circuit closing trigger mechanism 301 can be changed to change the time to open a circuit and the time to close a circuit respectively by altering the mass of the plunger 60*a* and that of the plunger 61*a*.

What is claimed is:

1. A switchgear operation mechanism for driving a movable contact to reciprocate so as to bring the switchgear from a closed circuit condition to an open circuit condition and vice versa, the mechanism comprising:

a circuit opening spring that operates to open a circuit by discharging energy;

a circuit opening trigger mechanism that maintains a state of energy accumulation of the circuit opening spring;

a circuit opening operation section that releases the circuit opening trigger mechanism from constraint;

a circuit closing spring that operates to close the circuit by discharging energy;

a circuit closing trigger mechanism that maintains a state of energy accumulation of the circuit closing spring; and a circuit closing operation section that releases the circuit closing trigger mechanism from constraint;

at least either the circuit opening operation section or the circuit closing operation section including:

an electromagnetic solenoid having a fitting structure provided with a step; and a solenoid spacer that adjusts a distance between the circuit opening trigger mechanism or the circuit closing trigger mechanism to be operated by the electromagnetic solenoid and the electromagnetic solenoid;

the electromagnetic solenoid having:

a solenoid housing fixed by way of the solenoid spacer;

a plunger slidable relative to the solenoid housing;

a plunger return spring urging the plunger in a plunger returning direction;

a coil rigidly fitted to the solenoid housing to drive the plunger to slide in a direction of magnetic excitation operation opposite to the plunger returning direction against the urging force of the plunger return spring by generating a magnetically excited state by electric power supplied to the coil; and a stopper fitted to the solenoid housing so as to limit sliding motion of the plunger in the plunger returning direction when no electric power is supplied to the coil, limiting position thereof being adjustable, wherein the plunger includes:

a cylindrical plunger main body located facing to the coil and adapted to slide; and a step section arranged at an end of the plunger main body in a direction of magnetic excitation operation and having a diameter smaller than the plunger main body and a length defined as step size; and the solenoid housing includes:

a base held in contact with the solenoid spacer and having a depth equal to the step size; and a housing main body containing the coil, the stopper being fitted to the housing main body.

2. The switchgear operation mechanism according to claim 1, wherein the stopper has:

a cylindrical stopper guide having a guide male screw formed on outer periphery thereof and adapted to be screwed and inserted into housing female screw formed in the solenoid housing, the guide male screw having a guide through hole running through the guide male screw in axial direction thereof;

a stopper pin extending through the guide through hole to contact an end of the plunger and having a step section to be engaged with an end of the stopper guide in the solenoid housing; and a nut arranged at outside of the solenoid housing to receive the guide male screw screwed into the nut and fix the position of the stopper pin.

3. The switchgear operation mechanism according to claim 1, wherein the base is separable from the housing main body; and a plurality of sets of a base and a plunger with different step sizes are provided so as to be mutually replaceable.

4. The switchgear operation mechanism according to claim 1, wherein a plurality of plungers having different masses are provided so as to be mutually replaceable.

5. The switchgear operation mechanism according to claim 1, wherein the circuit opening trigger mechanism has:

a latch lever fixed to a sub shaft;

a latch releasably engaged with the latch lever;

a tripping link for releasing the engagement of the latch lever and the latch by pulling the latch;

a tripping lever to be engaged with the tripping link so as to pull the tripping link by being pushed by the plunger when the electromagnetic solenoid is magnetically excited;

a tripping lever return spring that urges the tripping lever toward the plunger; and a tripping lever stop pin that stops the tripping lever at a predetermined position against a motion directed toward the plunger by engaging with the tripping lever when the electromagnetic solenoid is in a magnetically unexcited state; and the tripping lever pin can be rotated around the anchoring side shaft for adjustment and also fixed in position such that a position where the rotational motion of the tripping lever is stopped can be adjusted by means of the tripping lever stop pin as a position of engagement with the tripping lever changes by a rotational motion thereof.

6. The switchgear operation mechanism according to claim 1, wherein the trigger mechanism has:

a circuit closing lever fixed to the circuit closing shaft;

a ratchet pawl fixed to a circuit closing lever;

a circuit closing lock lever to be releasably engaged with the ratchet pawl and disengaged from the ratchet pawl by being pushed by the plunger when the electromagnetic solenoid is magnetically excited;

a circuit closing lock lever return spring that urges the circuit closing lock lever toward the plunger; and a circuit closing lock lever stop pin that stops the circuit closing lock lever against a motion toward the plunger at a predetermined position by means of engagement with the circuit closing lock lever when the electromagnetic solenoid is in a magnetically unexcited state; and the circuit closing lock lever stop pin can be rotated around an anchoring side shaft for adjustment and also fixed in position such that position where rotational motion of the circuit closing lock lever is stopped by the circuit closing lock lever stop pin can be adjusted by means of the circuit closing lock lever pin as a position of engagement with the circuit closing lock lever changes by rotational motion.

7. A switchgear comprising:

a movable contact; and a switchgear operation mechanism that drives the movable contact to reciprocate so as to bring the switchgear from a closed circuit condition to an open circuit condition and vice versa, the switchgear operation comprising:

a circuit opening spring that operates to open a circuit by discharging energy;

a circuit opening trigger mechanism that maintains a state of energy accumulation of the circuit opening spring;

a circuit opening operation section that releases the circuit opening trigger mechanism from constraint;

a circuit closing spring that operates to close the circuit by discharging energy;

a circuit closing trigger mechanism that maintains a state of energy accumulation of the circuit closing spring; and a circuit closing operation section that releases the circuit closing trigger mechanism from constraint;

at least either the circuit opening operation section or the circuit closing operation section including:

an electromagnetic solenoid having a fitting structure provided with a step; and a solenoid spacer that adjusts a distance between the circuit opening trigger mechanism or the circuit closing trigger mechanism to be operated by the electromagnetic solenoid and the electromagnetic solenoid;

the electromagnetic solenoid having:

a solenoid housing fixed by way of the solenoid spacer;

a plunger slidable relative to the solenoid housing;

a plunger return spring urging the plunger in a plunger returning direction;

a coil fixed to the solenoid housing to drive the plunger to slide in a direction of magnetic excitation operation opposite to the plunger returning direction against the urging force of the plunger return spring by generating a magnetically excited state by electric power supplied to the coil; and a stopper fitted to the solenoid housing so as to limit sliding motion of the plunger in the plunger returning direction when no electric power is supplied to the coil, limiting position thereof being adjustable, wherein the plunger includes:

a cylindrical plunger main body located facing to the coil and adapted to slide; and a step section arranged at an end of the plunger main body in a direction of magnetic excitation operation and having a diameter smaller than the plunger main body and a length defined as step size; and the solenoid housing includes:

a base held in contact with the solenoid spacer and having a depth equal to the step size; and a housing main body containing the coil, the stopper being fitted to the housing main body.

8. The switchgear operation mechanism according to claim 7, wherein the base is separable from the housing main body; and a plurality of sets of a base and a plunger with different step sizes are provided so as to be mutually replaceable.

9. The switchgear operation mechanism according to claim 2, wherein a plurality of plungers having different masses are provided so as to be mutually replaceable.

10. The switchgear operation mechanism according to claim 2, wherein the circuit opening trigger mechanism has:

a latch lever fixed to a sub shaft;

a latch releasably engaged with the latch lever;

a tripping link for releasing the engagement of the latch lever and the latch by pulling the latch;

a tripping lever to be engaged with the tripping link so as to pull the tripping link by being pushed by the plunger when the electromagnetic solenoid is magnetically excited;

a tripping lever return spring that urges the tripping lever toward the plunger; and a tripping lever stop pin that stops the tripping lever at a predetermined position against a motion directed toward the plunger by engaging with the tripping lever when the electromagnetic solenoid is in a magnetically unexcited state; and the tripping lever pin can be rotated around the anchoring side shaft for adjustment and also fixed in position such that a position where the rotational motion of the tripping lever is stopped can be adjusted by means of the tripping lever stop pin as a position of engagement with the tripping lever changes by a rotational motion thereof.

11. The switchgear operation mechanism according to claim 2, wherein the trigger mechanism has:

a circuit closing lever fixed to the circuit closing shaft;

a ratchet pawl fixed to a circuit closing lever;

a circuit closing lock lever to be releasably engaged with the ratchet pawl and disengaged from the ratchet pawl by being pushed by the plunger when the electromagnetic solenoid is magnetically excited;

a circuit closing lock lever return spring that urges the circuit closing lock lever toward the plunger; and a circuit closing lock lever stop pin that stops the circuit closing lock lever against a motion toward the plunger at a predetermined position by means of engagement with the circuit closing lock lever when the electromagnetic solenoid is in a magnetically unexcited state; and the circuit closing lock lever stop pin can be rotated around an anchoring side shaft for adjustment and also fixed in position such that position where rotational motion of the circuit closing lock lever is stopped by the circuit closing lock lever stop pin can be adjusted by means of the circuit closing lock lever pin as a position of engagement with the circuit closing lock lever changes by rotational motion.

* * * * *